United States Patent [19]

Alberti et al.

[11] Patent Number: 4,655,151

[45] Date of Patent: Apr. 7, 1987

[54] CONVERTIBLE WORK SUPPORT HOUSING FOR A SEWING MACHINE

[75] Inventors: Adriano Alberti, Pavia; Giancarlo Minella, Milan, both of Italy

[73] Assignee: Rockwell-Rimoldi S.p.A., Italy

[21] Appl. No.: 809,558

[22] Filed: Dec. 16, 1985

[30] Foreign Application Priority Data

May 27, 1985 [IT] Italy ..... 21970/85[U]

[51] Int. Cl.[4] ..... D05B 73/06

[52] U.S. Cl. ..... 112/168; 112/260

[58] Field of Search ..... 112/168, 260

[56] References Cited

U.S. PATENT DOCUMENTS

| | | | |
|---|---|---|---|
| 2,247,383 | 7/1941 | Hohmann et al. | 112/260 |
| 2,424,025 | 7/1947 | Gegauf | 112/260 |
| 2,723,638 | 11/1955 | Bell | 112/260 |
| 3,066,627 | 12/1962 | Schlosser et al. | 112/260 |
| 4,426,944 | 1/1984 | Bianchi | 112/260 |
| 4,493,280 | 1/1985 | Bianchi | 112/260 |

*Primary Examiner*—Werner H. Schroeder
*Assistant Examiner*—Andrew M. Falik

[57] ABSTRACT

A housing forming the free bed base in a sewing machine which is detachable from the remainder of the machine and which is comprised of a tray-shaped base module on which are mounted all lower sewing members that cooperate with the needle in the formation of stitches. These members include a needle plate, closing flat plates located alongside the opposite edges of the needle plate and closing interchangeable elements defining both the front and rear walls of the housing and the remaining portion of the upper flat surface of the latter which is not covered by the closing flat plates and the needle plate.

6 Claims, 7 Drawing Figures

CONVERTIBLE WORK SUPPORT HOUSING FOR A SEWING MACHINE

BACKGROUND OF THE INVENTION

The present invention relates to a housing for supporting fabric being sewn on a sewing machine, in particular the housing forming the cantilevered end of the sewing machine base which accommodates the components cooperating with the needle in order to form the stitch. As is known, sewing machines of the industrial type have a base which, in the region of the feed dog teeth, is shaped and structured in accordance with the operations to be performed. The base may have along its sides additional box-shaped elements designed to broaden the housing itself in a suitable manner and provide it with the most convenient shape. These additional elements, however, are used to a limited extent since they are always fixed in a relatively imprecise manner to the base housing, thereby partially obstructing the movement of the fabric. Also the said additional box-shaped elements in practice cannot be easily adapted to all the additional elements—for example fabric cutters and feed rollers, which are normally provided on the working surfaces. It must also be mentioned that the current state of the art provides housings with a flat surface and housings with a cylindrical surface, but not partially flat or partially cylindrical housings which may be very suitable for particular operations.

SUMMARY OF THE INVENTION

The general object of the invention is to devise a convertible housing for supporting fabric being sewn, which is able to overcome the abovementioned drawbacks.

Within the scope of this general object, it is an important object of the present invention to devise a housing such that the sewing machine with which it is associated offers maximum versatility and precision and is easy to use.

Another important object of the present invention is to devise a housing which has a simple structure is inexpensive and can be easily used even by unskilled operators.

These objects and other objects as well, which will emerge more clearly below, are substantially achieved by a housing for supporting fabric being sewn on a sewing machine, of the type which forms the cantilevered end of the sewing machine base and contains the components cooperating with the needle in order to form the stitch. This housing is detachable from the machine and comprises a tray-shaped base module adapted to accommodate the lower sewing members that cooperate with the needle in forming stitches, a needle plate mounted on the upper part of the tray-shaped base module above the sewing members, flat-shaped plates for closing the upper middle part of the tray module located alongside opposite edges of the needle plate, a tiltable end piece mounted on the side of the free end of the tray module immediately adjacent one of the flat shaped closing plates, and shaped interchangeable closing elements defining both the front and rear side walls of the housing and the remaining upper flat surface part of the latter not covered by the flat shaped closing plates, which upper flat surface part forms, with these closing plates and with the needle plate the working surface of the housing. The shaped closing elements are provided in a plurality of differing configurations to accommodate different types of sewing requirements.

DESCRIPTION OF THE DRAWINGS

Further characteristic features and advantages will emerge more clearly from the description of the invention illustrated by way of example in the attached drawings in which.

DESCRIPTION OF THE INVENTION

Figure 1:
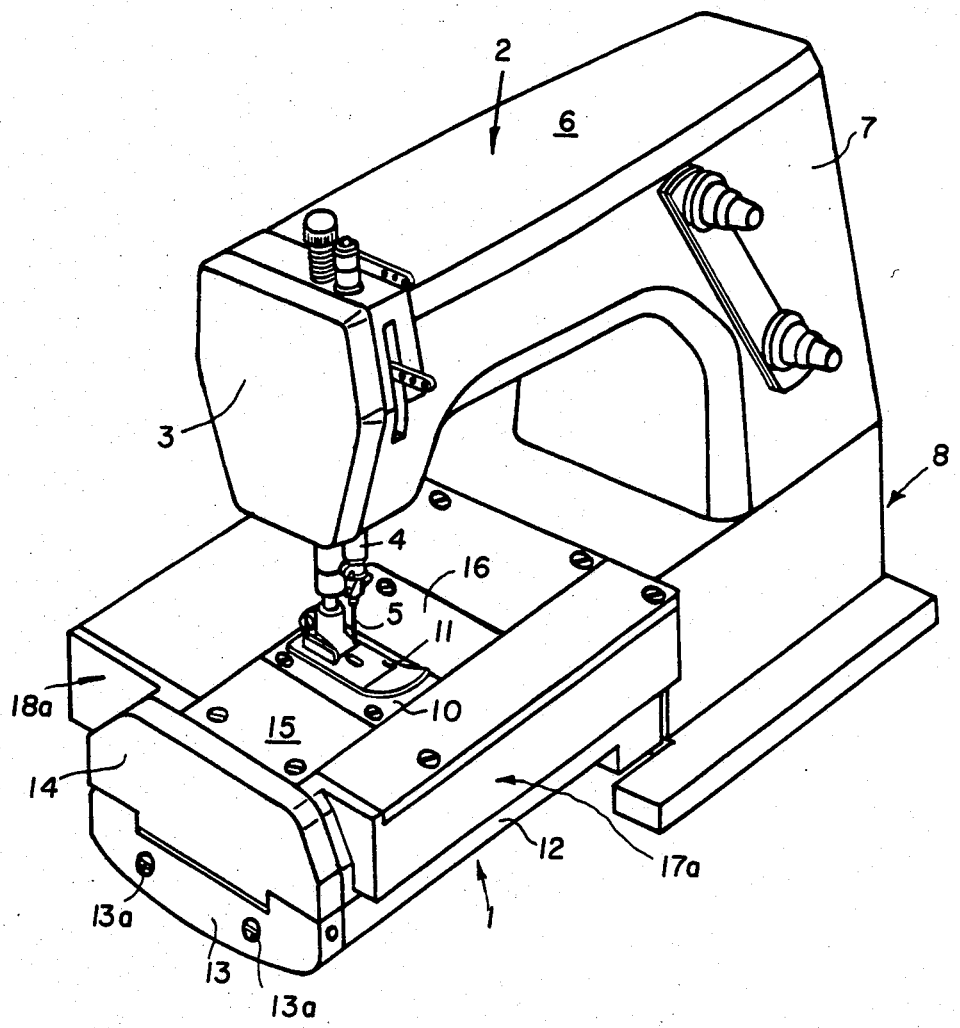
FIG. 1 is an overall perspective view of a sewing machine provided with a support housing of the type with a flat surface.

With reference to the abovementioned figures, the housing according to the present invention, which is indicated in its entirety by the number 1, forms part of a sewing machine 2. The latter consists, in a manner known per se, of a head-piece 3 which has passing through it a needle bar 4 with a needle 5 at its bottom end, an arm 6, a side column 7 and a base 8 which extends from the column 7 to the zone where the needle 5 operates and where the base 8 itself forms a cantilevered housing 1. In a manner known per se, which does not concern the present invention, all the components which cooperate with the needle 5 in order to form the stitch are arrange inside the housing 1. These components may be structured in any manner, and only the feed dog teeth 9 for feeding the fabric during sewing are visible on the outside of the housing 1, surrounded by a specific needle plate 10 and with the pressure shoe 11 located above them.

According to the invention, the housing 1 comprises a tray-shaped base module 12 (FIGS. 6 and 7) which is open at the top and designed to accommodate all the components cooperating with the needle 5 in order to form the stitch. The base module or tray 12 is fixed, for example by means of screws, to the remaining part of the base 8 so as to be arranged in a cantilever fashion. At the opposite end, the tray 12 is provided with a half end-piece 13 which can be fixed to the latter by means of screws (13*a*) and which is connected, by means of a hinge, to an end-piece 14 which can be folded down.

Flat covering plates 15 and 16 are located in the upper middle part of tray 12, alongside the opposite edges of the needle plate 10. The flat covering plate 15 is located immediately adjacent to the tiltable end-piece 14. Finally, the tray-shaped base module 12 has shaped closing elements which define, both the front and rear side walls of housing 1 and the remaining upper flat surface part not covered by the flat covering plates 15 and 16. These elements are advantageously provided in a plurality of types and differ from each other in the areas of their upper flat surface parts and in the roundings located in the region of their front and rear side walls where they join with the upper flat surface parts.

More particularly, front shaped elements having the same shape as identified by numeral 17*a* or as identified by numeral 17*b* are mounted on tray 12 before the needle 5, whereas rear shaped elements having the same shape as identified by numeral 18*a* or as identified by numeral 18*b* are mounted on tray 12 on the opposite side with respect to the preceding ones.

The shaped elements 17*a* and 18*a* each have a large and flat upper portion of working surface and therefore, when they are mounted together on the tray 12, they form a flat bed base. On the contrary, the shaped elements 17*b* and 18*b* are rounded in the region of the junction area between the side walls thereof and the upper flat surface parts and have each a narrow upper portion of working surface and therefore, when they are mounted together on the tray, they define a cylindrical bed base.

Figure 6:
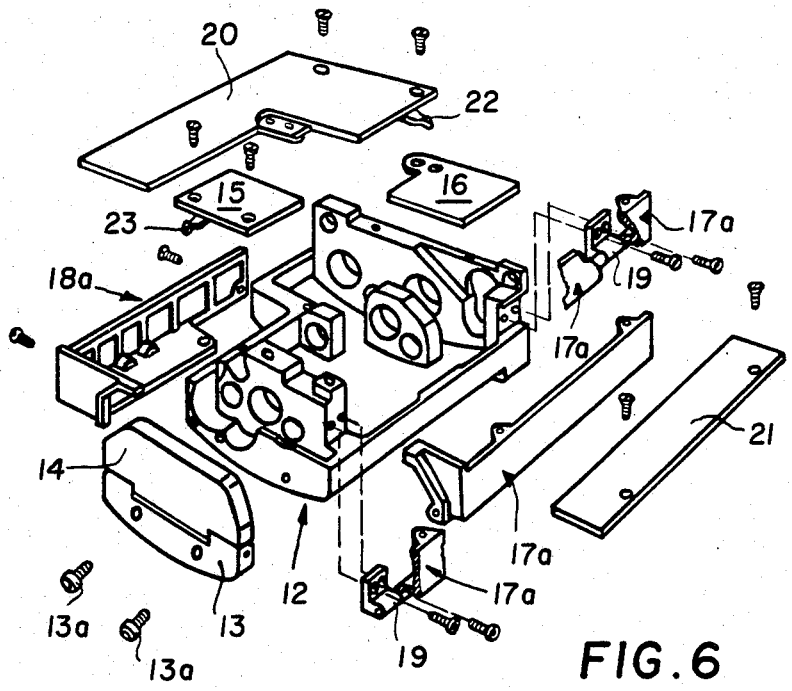
FIG. 6 shows an exploded and detailed view of the housing shown in FIG. 2.
Figure 7:
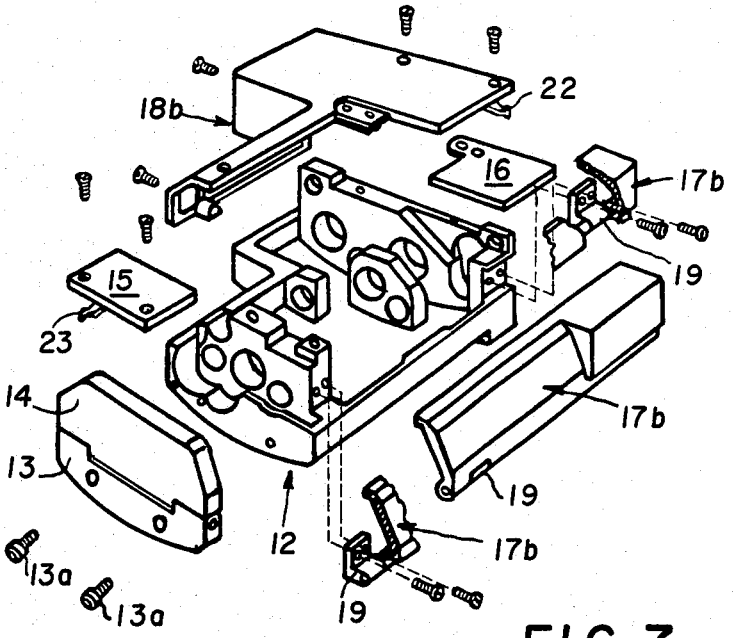
FIG. 7 also shows an exploded and detailed view of the housing shown in FIG. 3.

It is pointed out that, as shown in FIGS. 6 and 7, the front shaped elements 17*a*, 17*b* are fixed to the tray 12 by means of hinges 19 whereas the rear shaped elements 18*a*, 18*b* are fixed by means of screws. Moreover, the upper flat surface parts of the rear shaped element 18*a*, or first rear shaped element, are detachable and are formed by a plate 20 as shown in FIG. 6. The same flat parts, however, are integral with the second rear shaped element 18*b*, as shown in FIG. 7.

The first front shaped element 17*a* also has at the top a flat plate 21 (FIG. 6) of the detachable type. Both the upper flat parts 20 and the flat plate 21 can be fixed by means of screws.

It must also be pointed out that the covering plate 16 located alongside the needle plate 10 is fixed not to the tray 12, but to the flat parts of the rear shaped elements 18*a*, 18*b* by means of screws and that the tiltable end-piece 14 and the front shaped elements 17*a*, 17*b*, which can all be rotated about hinges can be fixed, by means of snap engagement, to elastic tongues 22, 23 fixed to the flat surface parts of the rear shaped elements 18*a*, 18*b* and to the covering plate 15, respectively.

Figure 2:
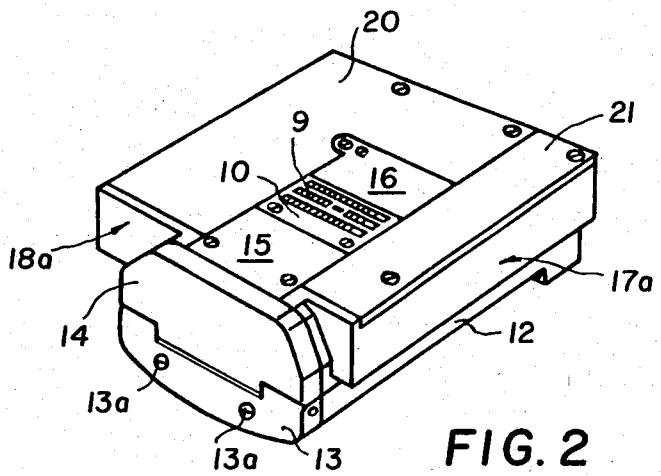
FIG. 2 shows an isolated and perspective view of the housing with a flat surface shown in first FIG. 1.
Figure 4:
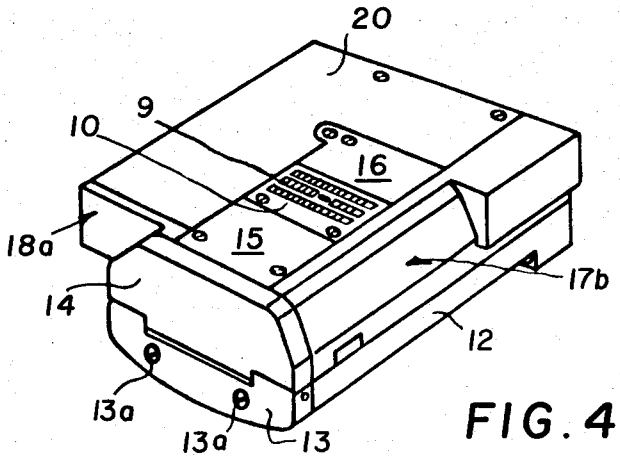

The use of the housing according to the present invention is shown in FIGS. 2 and 4. From the same figures it can be seen that, by appropriately choosing the shaped elements to be mounted, it is possible to produce as many as four different types of housing.

By mounting the first front shaped element 17*a* and the first rear shaped element 18*a*, it is possible to form a flat base (FIG. 2). This base is suitable for the sewing of substantially flat articles of clothing and may support or be provided with various accessory elements: lower trimming cutters, which project in front of the needle 5, the rear cutters which operate transversely to the direction in which sewing takes place so as to divide the semifinished articles between themselves, the rear feed rollers, etc.

Figure 3:
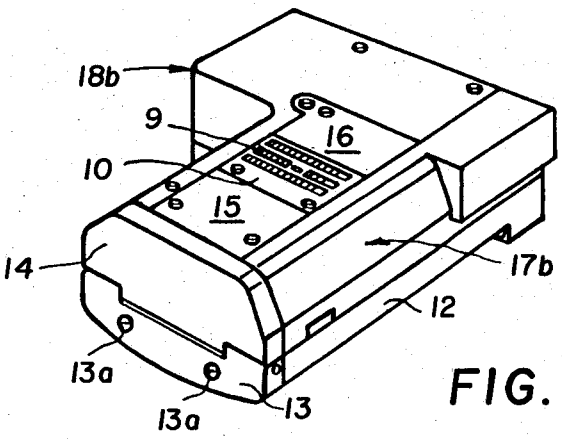
FIG. 3 shows the housing shown in the preceding Figures, shaped so as to have a cylindrical surface.

On the other hand, by mounting the second front shaped element 17*b* and the second rear shaped element 18*b*, a cylindrical base is formed (FIG. 3). This base is suitable for the sewing of tubular articles of clothing which engage with and are wound around the housing itself and made to rotate during sewing. This ease of operation is offset by the fact that, in view of the minimum extension of the upper flat surfaces, it is not possible to arrange lower trimming cutters and rear feed rollers on the said surface elements.

Figure 5:
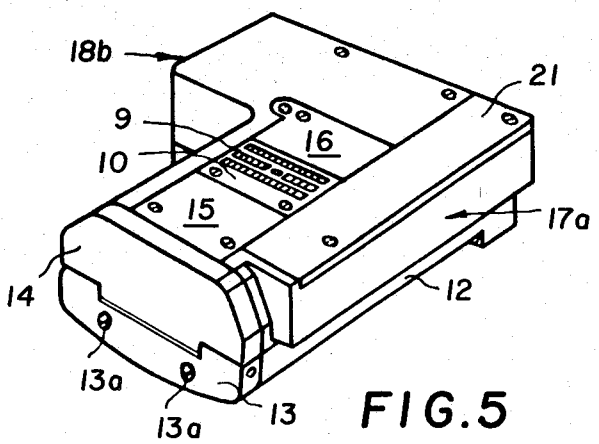
FIGS. 4 and 5 also show the housings of a sewing machine such as that shown in FIG. 1 which are partially flat-shaped and partially cylindrical.

In order to overcome this drawback, it is possible to form a base provided with a first front shaped element 17*a* and a second rear shaped element 18*b* (FIG. 5). In this case, it is possible to sew articles of clothing with ease. In view of the relatively limited amount by which the rear shaped element projects, it is still possible to include lower trimming cutters. In practice, a rear semicylindrical flat surface is obtained.

Alternatively, it is possible to provide a base on which the second front shaped element 17*b* and the first rear shaped element 18*a* are mounted. In this case, a front semicylindrical flat surface is obtained, useful for the sewing of articles of clothing which are substantially flat but which have additional elements supplied from below: for example the linings of articles of clothing, zippers and similar items. This type of housing, shown in FIG. 4, allows rear cutters and rear feed rollers to be mounted, in view of the relatively large dimensions of the first rear shaped element 18*a*. This invention thus achieves the proposed objects.

In fact, a fabric support housing has been devised which is very versatile and can be mounted in a considerable variety of forms, according to each particular requirement. Moreover, the elements which form this housing are in themselves simple and can be immediately mounted. All the details can be replaced by technically equivalent elements.

In practice, the materials used and the dimensions may be of any nature or magnitude, as required.

What is claimed is:

1. A housing forming the cantilevered bed base of a sewing machine and containing the lower stitching components cooperating with the needle of said machine in forming the stitches, a work support surface comprising a needle plate formed at the upper part on said housing, wherein said housing is detachable from said machine and comprises a tray-shaped base module designed to accomodate said lower stitching components, flat plates for closing the middle part of said work support surface located alongside the opposite edges of said needle plate, a tiltable end-piece mounted on the side of the free end of said base module immediately adjacent to one of said closing flat plates, and interchangeable closing shaped elements defining both the front and rear side walls of said housing and a flat surface part of said work support surface not covered by said closing flat plates and by said needle plate; said interchangeable shaped elements being provided in a plurality of types differentiated from each other by the different shape of said flat surface part thereof and by the roundings carried out in the region of the junction area between said side walls and the flat surface part.

2. A housing as claimed in claim 1, wherein the said shaped elements comprise a first front shaped element provided with an upper flat surface part and a first rear shaped element provided with an upper flat surface part, as well as a second front shaped element and a second rear shaped element which are rounded in the region between the front and rear side walls and the flat surface part, the said first elements being designed to form a flat bed base and the said second elements being designed to form a cylindrical bed base.

3. A housing as claimed in claim 2, wherein the said flat plate and upper flat parts are detachably fixed to the respective shaped elements.

4. A housing as claimed in claim 2, wherein said front shaped element with the associated upper flat plate and second front shaped element with the associated upper flat surface part are notatably fixed to said tray by means of hinges and are locked in closed position by means of snap engagement with an elastic tongue mounted on an associated upper flat surface part associated with said second rear shaped element.

5. A housing as claimed in claim 1, wherein said tiltable end-piece is fixed, by means of screws, on the free end of said tray, and wherein said tiltable end-piece can be locked in closed position by means of snap engagement with an elastic tongue.

6. A housing as claimed in claim 2, wherein detachable plates for covering the said tray are arranged between the said shaped elements and are positioned on opposite sides in relation to the needle plate, at least one of the said covering plates being directly fixed to the said tray by means of screws.

* * * * *